United States Patent [19]

Welch et al.

[11] Patent Number: 4,635,858

[45] Date of Patent: Jan. 13, 1987

[54] METHODS OF OPERATING BALL GRINDING MILLS

[75] Inventors: Phillip W. Welch, Houston, Tex.; Lawrence R. Roberts, Acton, Mass.

[73] Assignee: W. R. Grace & Co., Cambridge, Mass.

[21] Appl. No.: 223,833

[22] Filed: Jan. 9, 1981

[51] Int. Cl.[4] ..... B02C 25/00

[52] U.S. Cl. ..... 241/16; 241/35; 241/36; 241/101.3

[58] Field of Search ..... 241/16, 30, 101.3, 33–36

[56] References Cited

U.S. PATENT DOCUMENTS

| | | | |
|---|---|---|---|
| 2,405,059 | 7/1946 | Sahmel . | |
| 2,766,941 | 10/1957 | Weston . | |
| 3,607,326 | 9/1971 | Serafin . | |
| 3,944,146 | 3/1976 | Stockmann et al. . | |
| 4,026,479 | 5/1977 | Bradburn et al. . | |
| 4,210,290 | 7/1980 | Andersson et al. | 241/30 |

FOREIGN PATENT DOCUMENTS

| | | | |
|---|---|---|---|
| 223634 | 8/1959 | Australia . | |
| 81/01373 | 5/1981 | PCT Int'l Appl. . | |
| 783113 | 9/1957 | United Kingdom . | |
| 854782 | 11/1960 | United Kingdom | 241/30 |
| 949792 | 2/1964 | United Kingdom . | |
| 1098810 | 1/1968 | United Kingdom . | |
| 1244097 | 8/1971 | United Kingdom . | |
| 1596559 | 8/1981 | United Kingdom . | |

*Primary Examiner*—Mark Rosenbaum

*Attorney, Agent, or Firm*—Laurence R. Brown

[57] ABSTRACT

An electric motor operated rotary drum type grinding mill is operated at optimal efficiency by detecting and analyzing the motor current. The power signals are converted by signal processing equipment for presentation as pictorial display representations of mill operating conditions at a variety of motor current levels to permit unskilled operators to understand the current operating conditions. Instantaneous on line current signals are derived from the mill by a transformer coupling without rewiring or modification. Analytical equipment processes the detected current signals for mill control, storage of historical performance and pictorial display. Mill operation is accordingly controlled in semi-automatic or fully automatic modes that maintain optimum mill efficiency.

14 Claims, 2 Drawing Figures

METHODS OF OPERATING BALL GRINDING MILLS

TECHNICAL FIELD

This invention relates to electrical motor driven drum type ball grinding mills and more particularly it relates to methods of monitoring and operating such mills to improve throughput efficiencies.

BACKGROUND ART

The monitoring of a ball grinding mill or equivalent through electrical signals derived from the mill in operation has long been known. Representative of typical monitoring systems are those shown in U.S. Pat. Nos. 2,405,059—V. Sahmel, July 3, 1946; 2,766,941—D. Weston, Oct. 16, 1956; 3,944,146—H. Stockmann et al., Mar. 16, 1976; and 4,026,479—R. Bradburn et al., May 31, 1977.

Each of these systems depend upon sound signals derived from the mill operation. However, sound signals are neither pure nor primary signals and lead to complex means for analysis and selection of different operating characteristics It is easily recognizable that a sound frequency, magnitude or characteristic pattern will change considerably over changes in loading, speed and material constituency, size and characteristics. Also in the mill environment there are extraneous sounds which will affect such systems. Therefore for operation where significant ranges of materials and different ball mill conditions exist, a sound operated system tends to be restricted to sensing a particular limited condition in a particular mill to which it is custom tailored. It is therefore desirable to establish signals more universally significant and less susceptible to error from extraneous causes.

Furthermore, the sound derived signals which are tailored to specific mill conditions are significantly altered by the physical nature of the materials being processed. Thus, for example, if a chemical additive to the raw materials affects the physical behavior of the materials enough to improve the mill throughput efficiency, it also affects the sound. Thus, preselected patterns of sound signals may not properly detect material differences in throughput efficiency which should be monitored and controlled.

There are also other shortcomings of the prior art systems and methods because the nature of the mill operation is not understood or has not been adopted as an integral part of the monitoring and control methods. Thus, for example, a number of interrelated variables may effect efficiency, such as the amount of charge of materials in the mill, the charge characteristics including the chemical additives used, and the ball grinding efficiency. Nevertheless, most systems and methods are responsive only to single control factors such as the rate of flow of materials through the mill without regard to the grinding efficiency, which could change drastically in characteristic depending upon other mill conditions. It is therefore desirable to employ control signals representative of complex interactions in the mill yet indicative of the true throughput efficiency of a uniform product.

Also it is desirable to have methods and signals available for both instantaneous on-line and long term analysis of mill conditions. Few control methods or systems afford a compatible dual capability of this sort.

Particularly for use under semi-automatic operation with operator intervention or operator analysis of mill conditions in set up maintenance or control functions, it becomes necessary to communicate mill conditions in a way that cannot be misinterpreted, or misunderstood or overlooked. In this respect any signals or displays which make an operator depend upon the visual sensing of a particular value of a variable signal magnitude or meter reading, tend to cause operator error, particularly where operators may not have significant mill operation analysis skills.

Accordingly, it is a general objective of this invention to improve the prior art methods of deriving signals, displays and operational controls of grinding mills. Throughout the following description, drawings and claims further objectives, advantages and features of the invention will be set forth.

BRIEF DISCLOSURE OF THE INVENTION

It has therefore been established in accordance with the present invention that reliable, comprehensive and convenient electrical control signals may be derived from monitoring solely the power changes of an electric drive motor rotating the ball mill drum. Thus, the desired mill operating condition is established by the criterion of running at a constant speed with a synchronous motor while effectively grinding a desired charge and the motor is operated in that condition at an intermediate point on a variably detectable range of the power curve.

This set of conditions permits the mill to be monitored and controlled simply as a function of the amplitude of motor power signals easily detected and processed, yet carrying comprehensive mill operational characteristics including the amount of properly ground output materials used, the amount of raw material feed desirable, the loading and volume of materials inside the mill drum, the nature of operation of the balls (or rods), and the effect or optimum usage of chemical additives capable of increasing the mill efficiency.

The motor power signal magnitude is then processed to produce control signals for purposes of operating displays and control functions, preferably in a combination of signal magnitudes showing undershoot and overshoot of the desired mill operating conditions, and enabling control either by semi-automatic operator intervention or fully automated feed of materials and chemicals to attain optimum efficiency both instantaneously and over the long term.

For long term historical operation to analyze and monitor mill performance, the instantaneous real-time signal is stored and recalled when desired.

A set of pictorial representations of actual mill conditions enabling a semi-skilled operator to understand the nature of the mill condition without analysis or interthe polation is presented in response to the motor load signals.

Thus, the present invention provides a comprehensive and reliable mill analysis and understanding from a simply derived and processed signal, namely the horsepower of the motor. This invention provides a novel manner of knowing on the basis of horsepower whether the charge volume in a mill is too great or too small, a heretofore unknown mode of operation as acknowledged by the aforesaid U.S. Pat. No. 2,766,941.

DETAILED DESCRIPTION OF THE PREFERRED EMBODIMENTS

Figure 1:
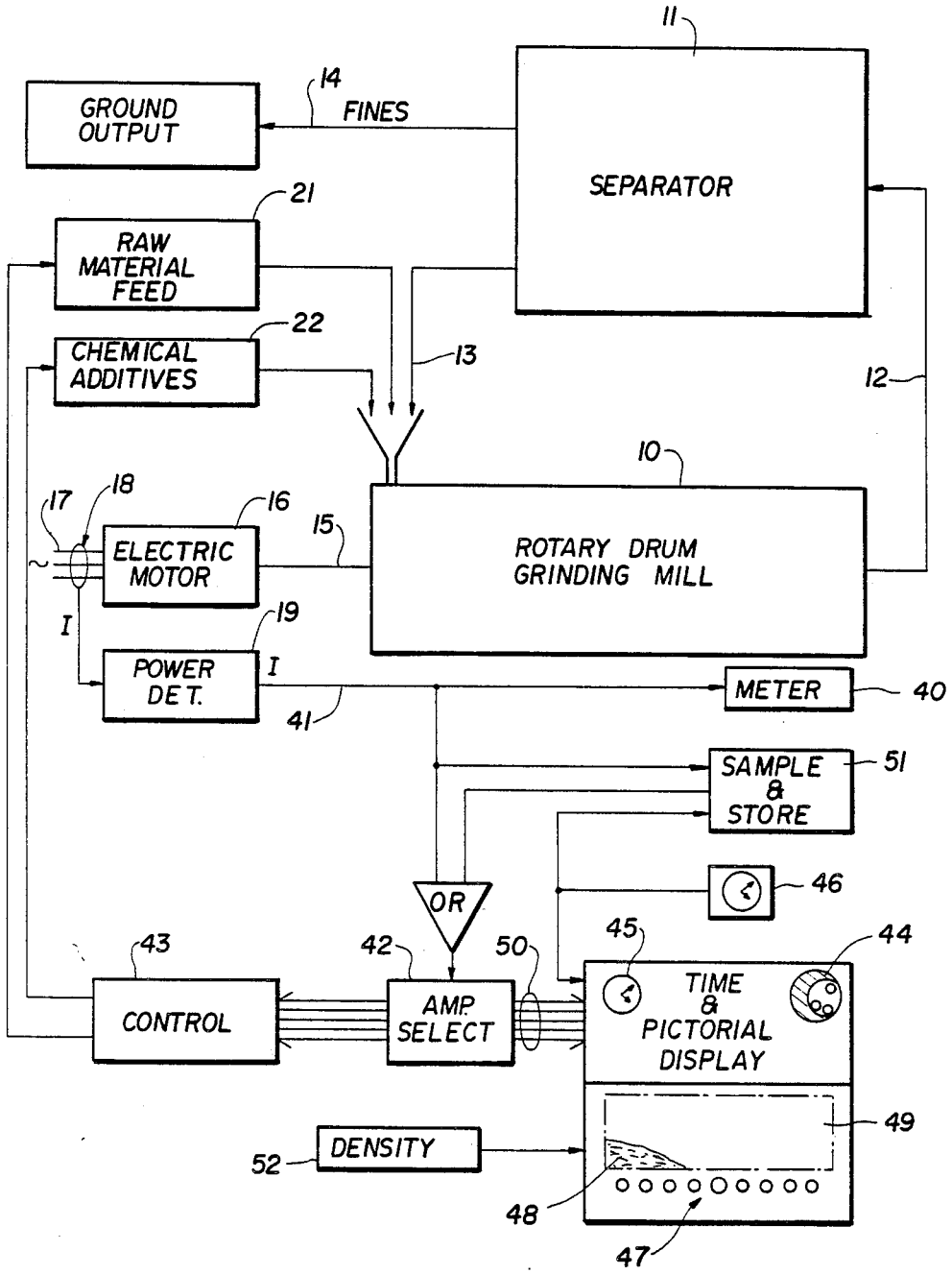
FIG. 1 is a block system diagram of a mill control system embodying the invention.

As may be seen in FIG. 1 a ball mill generally comprises a rotary drum 10, a separator 11, feed line 12 and recirculation line 13 for reintroducing coarse particles from feed line 12 back into the rotary drum 10. The output grinding products passed by separator 11 are withdrawn by way of output line 14.

The rotary drum 10 is driven by the shaft 15 of an electric motor 16 having input electrical lines 17. Typically the drum is rotated at a known constant speed ascertained by gearing (not shown) and synchronous motor speed. Such motors will draw the necessary current from line 17 (which presents constant input voltage) to operate under various load conditions. Thus, changes of line current will represent load changes. This parameter (current) is easily detected from an alternating current line (as represented by the ~ symbol) by means of an a-c coupled current transformer 18 about the line so that a signal proportional to the power is conventionally produced in suitable detector means 19. This is the sole detected signal necessary to produce a comprehensive analysis of mill conditions in accordance with the invention.

In order to better understand the invention, it is desirable to consider some of the characteristics of mill operation. For this purpose reference is also made to FIG. 2, wherein the graph displays on its abscissa the load of the rotary drum 10 on the motor 16 which is related to the charge of raw materials introduced into the drum 10 at input 20 from suitable raw material feed means 21.

Similarly chemical additives may be introduced by feed means 22 to affect the loading on the motor indirectly, since the corresponding volumes and weights are small compared to that of the raw materials such as clinkers from which cement is ground. In considering the load therefore the amount of recirculated raw materials into line 13 and drum input 20 then are also a factor. It is in this respect that the chemical additives at 22 affect the loading, since they are of a type that will improve the output efficiency of ground materials at line 14. Typical chemicals used for such purposes are set forth in U.S. Pat. No. 3,607,326—Frank G. Serafin, Sept. 21, 1971.

Figure 2:
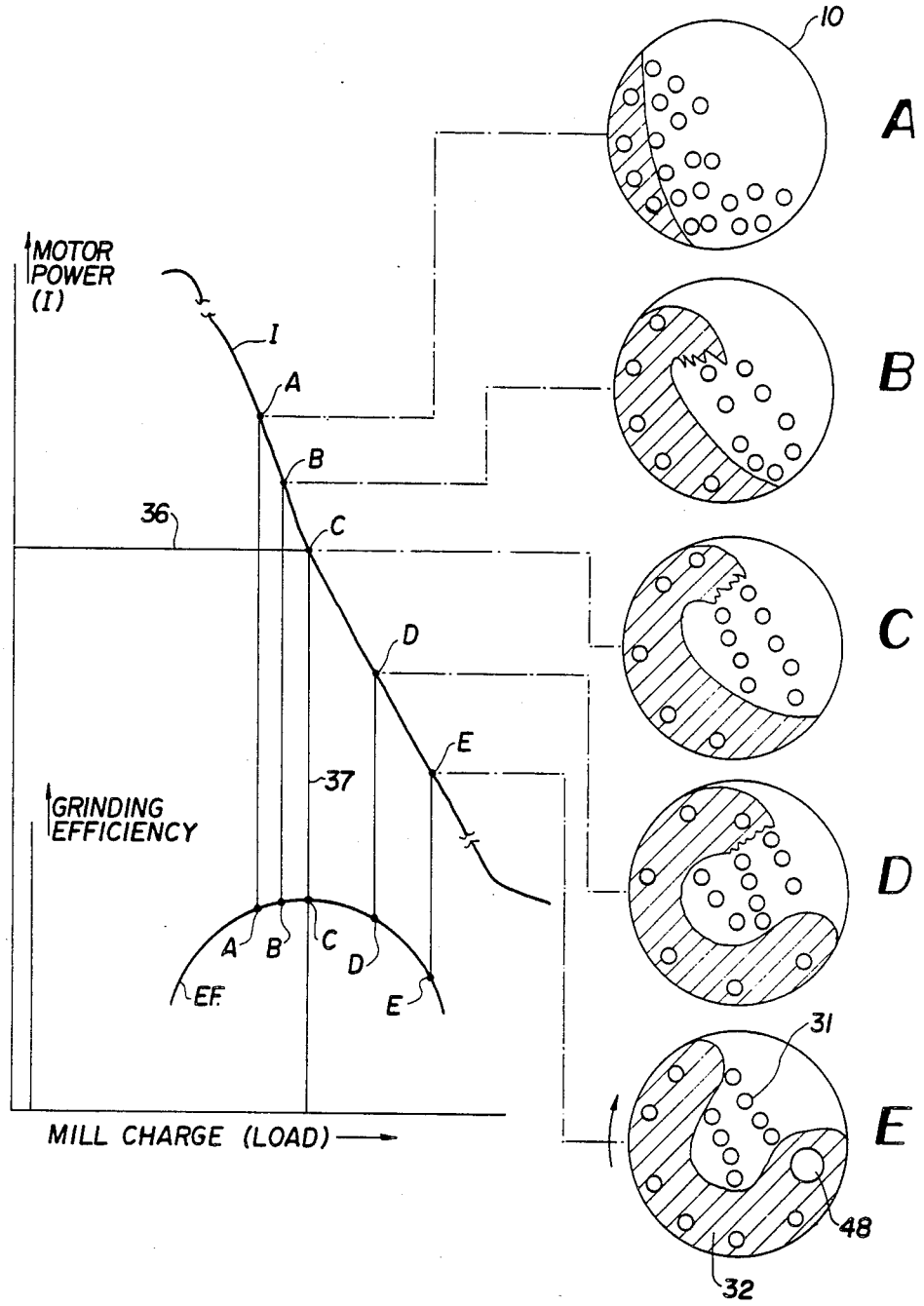
FIG. 2 is a graph displaying mill operating conditions used in accordance with this invention relating typical selected operational signal magnitudes to typical pictorial representations of the corresponding mill operating conditions.

Now consider the ordinate of the graph of FIG. 2, which displays two scales representative of pertinent performance characteristics, namely motor current I (power) and the grinding efficiency (Eff) on the raw materials, which is a function of the grinding medium, the density of the raw materials and the flow pattern through the rotary drum. To better understand the nature of these parameters, reference is made to the simulated pictorial representations A through E. These views represent diagrammatically a look at a drum 10 cross section along its axis while rotating with grinding medium balls and raw material charge to show the materials 30 and balls 31 at various volumetric charge loadings of the drum from underload A to overload E. The load condition C may be considered desired. It relates to a maximum grinding efficiency on curve Eff at point C and a chosen current operation datum C on the current curve I.

Referring to the grinding efficiency curve, Eff, the characteristic is present that for either greater or lesser loads, at points A, B, D, E, for example, the grinding efficiency is reduced. However, the current characteristic I changes in magnitude over the entire range of points A, B, C, D, E. Thus, the current I characteristic provides a detectable control signal that can indicate various mill charge loads are too great or too small, thereby to permit monitoring and correction to an optimum operation characteristic.

Typically the motor current curve I will over a measurable current range shown decrease from an underloaded condition A to an overloaded condition E, typified by profiles of internal mill conditions. These profiles may be considered an average or integrated combination of the drum profile conditions from one end to the other, since as may be seen pictorally at 49 in FIG. 1, the left hand input end of the drum may have a tunnel (48) from overload while absorbing input raw materials such as shown in profile E, while the right hand section may conversely have a profile more like that of profile A, the average condition providing preferred operating condition then being somewhat as C. These profiles A through E will be easily understood by unskilled or semi-skilled plant operators to indicate underload to overload conditions in the drum.

The pictorial drum representations depict drum 10 rotation clockwise so that the grinding medium balls 31 and the raw material hatched charge 30 are centrifugally and frictionally carried in patterns such as indicated as the load changes.

Higher motor current results with lighter raw material load A and lower motor current with the heavier load E where the tunnelling effect is evident. It can be reasoned that if the balls 30 in an overloaded condition E drop on a cushioned layer of raw materials, the grinding efficiency will be less than in the conditions C where a ball drop will impact a thinner layer of material. Also, the efficiency of underload condition A is low because the balls are hitting balls rather than raw materials.

It is evident then that both the nature of the flow pattern through the rotating drum and the mill grinding efficiency are indicatable simply in terms of the parameter of motor horsepower or current. Also, that a pictorial display of the mill conditions A to E will show an operator on premises a signal giving him a full understanding of the conditions so that he may calibrate automatic feed conditions or semi-automatically control feed rates. Conversely a load current reading such as might be displayed on meter 40 would not have a similar impact and could readily be overlooked because of attention necessary to monitor a continuously variable instantaneous reading and not flag critical conditions that require operator attention and understanding. These operational characteristics are described for example in the Cement Data Book, Walter H. Duda, Bauverlag, Wiesbaden, and in particular Chapter 5, pages 94 to 104.

It is not a trivial feature that this invention because of its universal nature and the use of a single easily derived signal, namely motor current, readily can be adapted and instrumentation added to existing ball mills without change or custom installation other than possible internal instrument calibration.

The processing of the motor load current detected (19) is quite simple to provide all the necessary operator and control signal information as seen in FIG. 1. The output current reading 41 may be displayed as a current or power reading on meter 40 for an instantaneous reading. However, as above stated this has little impact on delivering the meaning to a relatively unskilled operator. Thus, a schedule of selected critical conditions requiring operator action, such as the aforesaid conditions A to E, can be selected for control purposes by simply monitoring the current amplitudes at selector 42 to select the corresponding current values A to E on the ordinate of FIG. 1, for example. At any one of these conditions control can be triggered as suggested by block 43, either semiautomatically by operator intervention or fully automatically to alter raw material or additive feed rates, etc.

The principal display 44 is pictorial, that is, actual pictures or diagrammatic views such as shown in FIG. 2 are shown in video form, preferably along with the instantaneous real time reference signal at 45 as derived from a system clock 46.

This method of operation also is adaptable to storage and recall of mill operating conditions by means of any suitable analog or digital recorder. The segregated amplitude signals at leads 50 are in effect digitalized signals that may be coded and stored in digital form. In this embodiment the analog current signals (41) may be stored on for example a tape recorder 51, along with a periodic time indication or at a series of time intervals sampled by the clock 46 signals. For example, starting at mill startup time on a working shift of eight hours, the mill operation may be sampled and stored every fifteen minutes throughout the shift for recall and readback, thereby implicitly carrying a time indicia. A digital system can, of course, store clock time for every sample, and thus the output on leads 50 could be stored therewith, etc.

It is clear therefore that whenever deviations from expected mill throughput occur, the recordability of the signal is important to provide a historical review. Thus, the cause may be analyzed and corrected, even without full time operator attendance and attention.

A further flow pattern display may be derived such as lamp bank 47 which has an optimum central position so that under preferred operating conditions the internal flow pattern within simulated drum 49 will permit tunnelling 48 to proceed only to a predetermined distance along the length of the drum. As above indicated, the tunnelling of FIG. 2E is identified by reduced current from the desired operation current (C). Thus, the lights are lighted from left to right as a function of current to show flow tunnel 48 length conditions inside the drum 49 on the lamp array 47 as derived from the signals available (50). Thus, both the loading conditions (44) and flow conditions (47) are pictorially representable solely from the magnitude of the input motor current basic signal.

However, one other factor affects tunnelling (48), namely: raw material density. The fluffier or less dense the raw materials, the more fully (volume) loaded the drum is as represented by the displays 44 (FIG. 2A to 2E). Thus, the central idealized flow lamp in bank 47 may not coincide with the preferred loading pattern FIG. 2C but may rather match FIG. 2B or FIG. 2D if the raw materials are more or less dense. Therefore, it may be desirable to shift the flow picture 47 lamp lighting sequence to the right or left as a function of an input material density signal indicated at 52.

In controlling the mill it is important to correct for overloading and revert back to more efficient operation. This is a critical condition regarding chemical additives. The feed of raw materials and chemical additives then need to be adjusted to assure the same proportions of chemicals to raw materials, particularly during the period of reversion from overloading to normal operation. The ratio of chemicals to raw materials may be selected especially to aid the system to return to an equilibrium condition at the desired operating condition.

Therefore, the present invention provides improved and useful methods of operation and operational analysis of grinding mill performance with simple, effective and simply understood procedures and steps. Accordingly, those novel features believed representative of the spirit and nature of the invention are defined with particularity in the following claims.

Industrial Application

Methods of operation and analysis of operation of a grinding mill of the electric motor operated rotary drum type, particularly those for producing cement, are provided to improve mill output efficiency and to permit optimum feed of raw materials and chemical additives.

We claim:

1. The method of operating and monitoring an electric motor operated rotary drum type mill comprising the steps of,
   (a) establishing a desired high operating efficiency condition with a known load of materials operating at a known motor power,
   (b) operating the electrical drive motor with a partial mill charge at said established operating condition on an intermediate portion of the motor power curve wherein the motor power decreases and increases with load,
   (c) deriving from the electrical power delivered to the motor a motor power signal over a range including the power at positions on either side of said desired operating condition in an intermediate position on said range,
   (d) providing control signals responsive to the magnitude of said power signal indicative of the need for corrective action when load conditions are below or above said desired condition, and
   (e) providing indications of the mill condition from the power signal magnitude identifying the need for corrective action in the form of pictorial displays showing mill conditions as typical mill interior grinding patterns of media and load flowing through the mill selected to correspond to different magnitudes of the control signals, the displays signifying to operators the corrective action required to restore the mill load conditions to the desired condition.

2. The method defined in claim 1 including the step of displaying pictorial representations of the mill operating conditions in response to samples taken from the control signal.

3. The method defined in any one of claims 1 or 2 including the steps of storing the motor power signals derived at periodic sample times during mill operation, and playing back a history of mill operation from the stored signals.

4. The method defined in claim 1 including the step of operating the mill with a synchronous motor exhibiting said power curve.

5. The method defined in claim 1 including the step of operating the mill during said method steps (a) through (e) at a constant motor speed.

6. The method defined in claim 1 including the steps of providing a further visual display indicating the depth of tunnelling conditions in the mill in response to the magnitude of said power signal.

7. The method defined in claim 6 including the steps of sampling and storing signals representative of the control signals of different magnitudes at periodic intervals during mill operating identified by clock time, recalling the stored signals, and displaying the pictorial representations of the mill operating conditions in response to the recalled signals.

8. The method defined in claim 1 to control the efficiency of use of chemical additives including the steps of adding raw materials to be ground to the mill charge, adding chemicals affecting the physical behavior of the ground materials in a manner increasing the output efficiency of mill, and establishing from said motor power signal a continuous indication of the mill load conditions as affected by the addition of chemicals and materials to the mill charge.

9. The method defined in claim 8 improving the mill output efficiency by the additional steps of controlling the addition of raw materials and chemicals in proportion one to the other thereby maintaining said signal substantially at said desired condition.

10. The method of improving (a) throughput efficiency of a rotary drum type mill driven by an electrical motor to grind input raw materials and (b) the efficiency of use of chemical additives comprising the steps of, introducing into the mill a chemical additive affecting the physical behavoir of the ground materials in a manner increasing the output quantity of ground raw materials produced by the mill, deriving from the motor a power signal representative of loading of materials in the mill produced by the magnitude of the raw materials in the drum over a signal range, determining a desired intermediate magnitude within said range of said power signal indicative of a material load magnitude providing a desired operating condition in the mill, and controlling the amount of chemical additive in response to said signal magnitude to achieve increased output materials without waste of chemical additives.

11. The method of claim 10 including the step of reducing the additive when the power signal indicates a loading of materials in the mill greater than said desired operating condition.

12. The method of monitoring the operating conditions of a rotary drum type grinding mill driven by an electrical motor comprising the steps of, operating the mill by said motor over a variable range of power magnitude in the presence of raw material loads above and below a desired load, deriving a motor power signal intermediate in said range, controlling the load of materials in said mill in response to the motor power signal to maintain the power signal substantially at a desired intermediate value, and reproducing pictorial representations of internal mill conditions in response to a plurality of predetermined power magnitudes within said range.

13. The method of displaying operating conditions of an electrical motor driven rotary drum type grinding mill comprising the steps of, sampling an electrical signal representative of motor power as indicative of mill performance, and presenting different pictorial representations of mill conditions in the form of patterns of grinding media and load flow through the mill in response to different magnitudes of the sampled signal.

14. The method of claim 13 wherein the different pictorial representations presented comprise a simulated pattern of raw material flow along the length of the rotary drum.

* * * * *